US011215172B2

(12) United States Patent
Kroneis

(10) Patent No.: US 11,215,172 B2
(45) Date of Patent: Jan. 4, 2022

(54) HYDROSTATIC POSITIVE DISPLACEMENT MACHINE

(71) Applicant: Robert Bosch GmbH, Stuttgart (DE)

(72) Inventor: Markus Kroneis, Rottenburg am Neckar (DE)

(73) Assignee: Robert Bosch GmbH, Stuttgart (DE)

( * ) Notice: Subject to any disclaimer, the term of this patent is extended or adjusted under 35 U.S.C. 154(b) by 209 days.

(21) Appl. No.: 16/530,321

(22) Filed: Aug. 2, 2019

(65) Prior Publication Data

US 2020/0072205 A1 Mar. 5, 2020

(30) Foreign Application Priority Data

Aug. 28, 2018 (DE) ..... 10 2018 214 481.8

(51) Int. Cl.
*F04B 1/324* (2020.01)
*F04B 1/2078* (2020.01)
(Continued)

(52) U.S. Cl.
CPC ..... *F04B 1/324* (2013.01); *F03C 1/0686* (2013.01); *F04B 1/124* (2013.01); *F04B 1/20* (2013.01);
(Continued)

(58) Field of Classification Search
CPC ..... F04B 1/324; F04B 49/08; F04B 49/002; F04B 1/124; F04B 1/20; F04B 1/2035;
(Continued)

(56) References Cited

U.S. PATENT DOCUMENTS 2,300,009 A 10/1942 Rose
3,142,262 A 7/1964 Firth et al.
(Continued)

FOREIGN PATENT DOCUMENTS

CH 503 911 9/1969
DE 1 151 157 7/1963
(Continued)

OTHER PUBLICATIONS

German Search Report corresponding to German Application No. 10 2018 214 481.8, dated Apr. 3, 2019 (10 pages).

*Primary Examiner* — Peter J Bertheaud
(74) *Attorney, Agent, or Firm* — Maginot, Moore & Beck LLP

(57) ABSTRACT

A hydrostatic positive displacement machine has an adjustable swept volume, and has a lifting element, a rotor with positive displacement elements supported on the lifting element, and a hydraulic adjusting device that adjusts the swept volume and includes an adjusting piston that is mounted in or on a cylinder, is movable axially rectilinearly in relation to the cylinder, and is adjacent to a pressurizable adjusting chamber. A bearing gap is formed between a circular-cylindrical bearing surface of the adjusting piston and a circular-cylindrical bearing surface of the cylinder. The adjusting piston is mounted hydrostatically, wherein at least three pressure pockets are distributed uniformly in a row over the circumference of a bearing surface. Pressure fluid flows into each pressure pocket via a fixed throttle, which is assigned only to the respective pressure pocket, and flows out of each pressure pocket via the bearing gap.

15 Claims, 5 Drawing Sheets

(51) Int. Cl.

| | |
|---|---|
| ***F04B 1/124*** | (2020.01) |
| ***F04B 1/32*** | (2020.01) |
| ***F04B 1/20*** | (2020.01) |
| ***F04B 49/00*** | (2006.01) |
| ***F04B 1/328*** | (2020.01) |
| ***F04B 27/18*** | (2006.01) |
| ***F04B 27/10*** | (2006.01) |
| ***F03C 1/40*** | (2006.01) |
| *F03C 1/06* | (2006.01) |
| *F03C 1/32* | (2006.01) |
| *F04B 49/08* | (2006.01) |

(52) U.S. Cl.
CPC ..... *F04B 1/2078* (2013.01); *F04B 1/32* (2013.01); *F04B 1/328* (2013.01); *F04B 27/1054* (2013.01); *F04B 27/18* (2013.01); *F04B 49/002* (2013.01); *F03C 1/0636* (2013.01); *F03C 1/0652* (2013.01); *F03C 1/0668* (2013.01); *F04B 49/08* (2013.01)

(58) Field of Classification Search
CPC ..... F04B 1/32; F04B 1/328; F04B 1/2042; F04B 1/29; F04B 49/12; F04B 27/1054; F04B 27/18; F03C 1/0686; F03C 1/0652; F03C 1/0636; F03C 1/0668
See application file for complete search history.

(56) References Cited

U.S. PATENT DOCUMENTS

| | | | | |
|---|---|---|---|---|
| 6,725,658 | B1 * | 4/2004 | Lemmen | F04B 1/324 60/443 |
| 9,518,569 | B2 * | 12/2016 | Howind | F04B 1/2078 |
| 10,100,817 | B2 * | 10/2018 | Diebold | F01B 3/007 |
| 10,233,899 | B2 * | 3/2019 | Sauter | F16K 31/0613 |
| 10,914,294 | B2 * | 2/2021 | Miura | F04B 49/22 |

FOREIGN PATENT DOCUMENTS

| | | | |
|---|---|---|---|
| DE | 199 49 169 | A1 | 4/2001 |
| DE | 10 2014 212 205 | A1 | 12/2015 |
| DE | 11 2016 006 012 | T5 | 9/2018 |

* cited by examiner

HYDROSTATIC POSITIVE DISPLACEMENT MACHINE

This application claims priority under 35 U.S.C. § 119 to application no. DE 10 2018 214 481.8, filed on Aug. 28, 2018 in Germany, the disclosure of which is incorporated herein by reference in its entirety.

The disclosure relates to a hydrostatic positive displacement machine, the swept volume of which is adjustable and which has a lifting element, a rotor with positive displacement elements, which are supported on the lifting element, and, in order to adjust the swept volume, a hydraulic adjusting device which comprises an adjusting piston, which is mounted in or on a cylinder and is movable axially rectilinearly in relation to the cylinder and which is adjacent to a pressurizable adjusting chamber, wherein a bearing gap is formed between a circular-cylindrical bearing surface of the adjusting piston and a circular-cylindrical bearing surface of the cylinder.

BACKGROUND

A hydrostatic positive displacement machine of this type is known in the form of an axial piston pump of swashplate design from DE 199 49 169 C2, for example. In the case of this axial piston pump, positive displacement pistons, which are movable axially parallel to the axis of rotation of a drive shaft in a cylinder drum, which is coupled to the drive shaft for rotation therewith, are supported on a swashplate which is pivotable about a pivot axis in order to adjust the swept volume. For the adjustment, there is an adjusting device which comprises an adjusting piston which is cup-shaped and therefore has an interior space and is supported on the swashplate via a flattened and otherwise spherical sliding block, which is held in the swashplate, and with which the swashplate can be pivoted in the one direction. The interior space in the adjusting piston is part of an adjusting chamber for which the pressure fluid inflow and the pressure fluid outflow are controlled by one control valve or by a plurality of control valves and in which there is an adjusting pressure which is determined by the force necessary for pivoting or for holding the swashplate and by the operative surface of the adjusting piston. The swashplate is pivoted in the opposite direction by the positive displacement pistons which are under high pressure. For this purpose, the swashplate is pivotable about an axis which is at a distance from the axis of rotation of the drive shaft.

The tribological contact between the adjusting piston and the cylinder is effected by friction and therefore also by wear. This is therefore in particular also the case because transverse forces act on the adjusting piston during operation. In the case of the hydrostatic axial piston pump known from DE 199 49 169 C2, a relative movement between the sliding block and the adjusting piston takes place during pivoting of the swashplate. The friction generates a transverse force on the adjusting piston. In other constructions, the transverse forces on the adjusting piston may have other causes.

Hydrostatic positive displacement machines, the swept volume of which is adjustable, are also known in which the lifting element is adjusted by an adjusting piston, which is activated by a valve, in the one direction and by what is referred to as a counter piston, the operative surface of which is smaller than that of the adjusting piston and which is acted upon directly by the high pressure, in the other direction. The counter piston will also be subsumed under the term adjusting piston below.

Apart from hydrostatic axial piston machines, there are also hydrostatic radial piston machines and hydrostatic vane-type machines with adjusting devices for adjusting the swept volume.

SUMMARY

The disclosure is based on the object of developing a hydrostatic positive displacement machine of the type in question in such a manner that the friction and the wear in the adjusting device are low.

This object is achieved for a hydrostatic positive displacement machine of the type referred to at the beginning in that the adjusting piston is mounted hydrostatically, wherein at least three pressure pockets are distributed uniformly in a row over the circumference of a bearing surface, and wherein pressure fluid flows into each pressure pocket via a fixed throttle, which is assigned only to the respective pressure pocket, and flows out of each pressure pocket via the bearing gap. In the case of such a hydrostatic mounting, each pressure pocket is arranged fluidically between the fixed throttle and a variable throttle formed by the bearing gap. If the bearing gap width increases on a first side of the adjusting piston, because the adjusting piston moves toward the opposite, second side, the throughflow cross section of the variable throttle(s) becomes greater on the first side and the pressure in the pressure pockets on the first side drops. On the second side, the bearing gap becomes narrower, and therefore the throughflow cross section of the variable throttle becomes smaller and the pressure in the pressure pockets of the second side rises. The force imbalance forces the adjusting piston back again into a central position in which the bearing gap width is constant all the way around. This result arises independently of the loading.

The disclosed arrangement can be used for hydrostatic positive displacement machines which are designed as a pump or as a motor or are operable in both manners of operation.

In a particularly simple embodiment, the fixed throttles are arranged between the adjusting chamber and the pressure pockets. The pressure fluid flows into the pressure pockets from the adjusting chamber.

The diameter of the fixed throttles in the form of bores lies preferably within the range of between 0.05 mm and 0.5 mm, and therefore only little pressure fluid is required for the hydrostatic mounting of the adjusting piston.

All of the pressure pockets can have the same shape and size and all of the fixed throttles can have the same diameter.

A plurality of rows of pressure pockets are preferably present in the direction of movement of the adjusting piston, i.e. one behind another in the axial direction, in a bearing surface. In the case of such an arrangement, a constant height of the bearing gap can be achieved over a large part of the guided length or over the entire guided length of the adjusting piston. It is advantageous if pressure pockets are located at least in that region of a bearing surface overlapped by the other bearing surface in each position of the adjusting piston. This has the advantage that pressure fluid does not flow directly through a bearing gap into the housing of the positive displacement machine without throttling via the fixed throttles and the pressure pockets, which are located on a part of the bearing surface that is not overlapped by the other bearing surface in every position of the adjusting piston, and therefore the quantity of pressure fluid necessary for the hydrostatic mounting is kept low.

Various shapes are conceivable for the pressure pockets. The pressure pockets can be polygons, in particular triangles or quadrangles, in particular rectangles, in particular squares. Ellipses, in particular circles, are also conceivable. The pressure pockets are preferably rectangular.

The extent of the pressure pockets is likewise preferably greater in the circumferential direction than in the axial direction, in particular the pressure pockets are approximately 10 times as large in the circumferential direction as in the axial direction.

The pressure pockets are advantageously located in the bearing surface of the adjusting piston since the latter as an individual part can readily be machined in a simple manner.

Hydrostatic positive displacement machines are known in which the adjusting piston is configured in a cup-shaped manner with an interior space as adjusting chamber or as part of the adjusting chamber and is mounted and guided with its outer surface in the cylinder. In one particular embodiment, the pressure pockets are located in the outer surface of the adjusting piston, wherein the fixed throttles are formed by bores which lead from the interior space through the wall of the adjusting piston into the pressure pockets. If the adjusting piston is guided on a cylinder, the pressure pockets can be located on the outer side of the cylinder.

The pressure pockets can also be located in that bearing surface of the two bearing surfaces which is directed inward. This has the advantage that pressure pockets can be present over the entire guide length without pressure fluid flowing out of the adjusting chamber via the fixed throttles and the pressure pockets into the housing of the positive displacement machine. The pressure pockets which are not overlapped by the other bearing surface are open toward the adjusting chamber in the inlet and in the outlet and do not have any effect.

Pressure pockets can be present in a bearing surface over virtually the entire axial length thereof.

The disclosed arrangement can be used with particular advantages in the case of hydrostatic axial piston machines, in particular in the case of hydrostatic axial piston machines of swashplate design, in which the adjusting piston is movable essentially in the axial direction, i.e. in the direction of the axis of the drive shaft.

A hydrostatic mounting according to the disclosure of the adjusting piston is particularly advantageous for an adjusting piston which is adjacent to an adjusting chamber, the fluid charging of which is controlled by a valve. Such an adjusting piston conventionally has quite a large cross section, and therefore the ratio of guide length to cross section is quite small. An optionally present counter piston acted upon permanently by the high pressure has a smaller cross section than the adjusting piston. Therefore, the ratio of guide length to cross section is also generally more advantageous in a counter piston than in the adjusting piston. A hydrostatic mounting is therefore particularly advantageous in the case of an adjusting piston, but is also of advantage in the case of a counter piston.

BRIEF DESCRIPTION OF THE DRAWINGS

Two exemplary embodiments of a hydrostatic positive displacement machine according to the disclosure that are each in the form of a hydrostatic axial piston pump of swashplate design and also various types of adjusting piston are illustrated in the drawings. The disclosure will now be explained in more detail with reference to the figures of said drawings.

In the figures.

DETAILED DESCRIPTION

Figure 1:
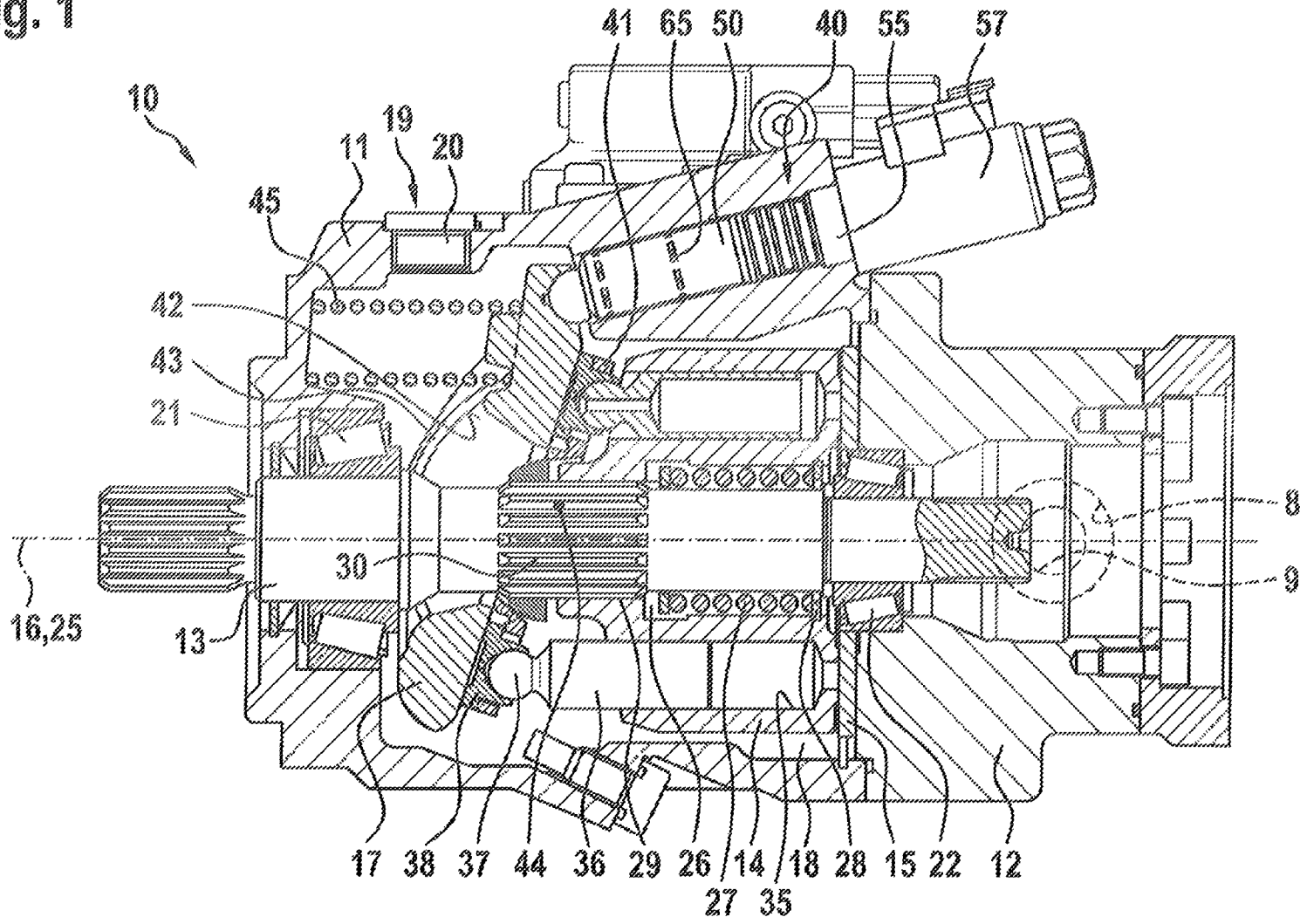
FIG. 1 shows a longitudinal section through the first exemplary embodiment, in which the swashplate is pivoted in the one direction by an adjusting piston and in the opposite direction by a spring and by drive mechanism forces.
Figure 2:
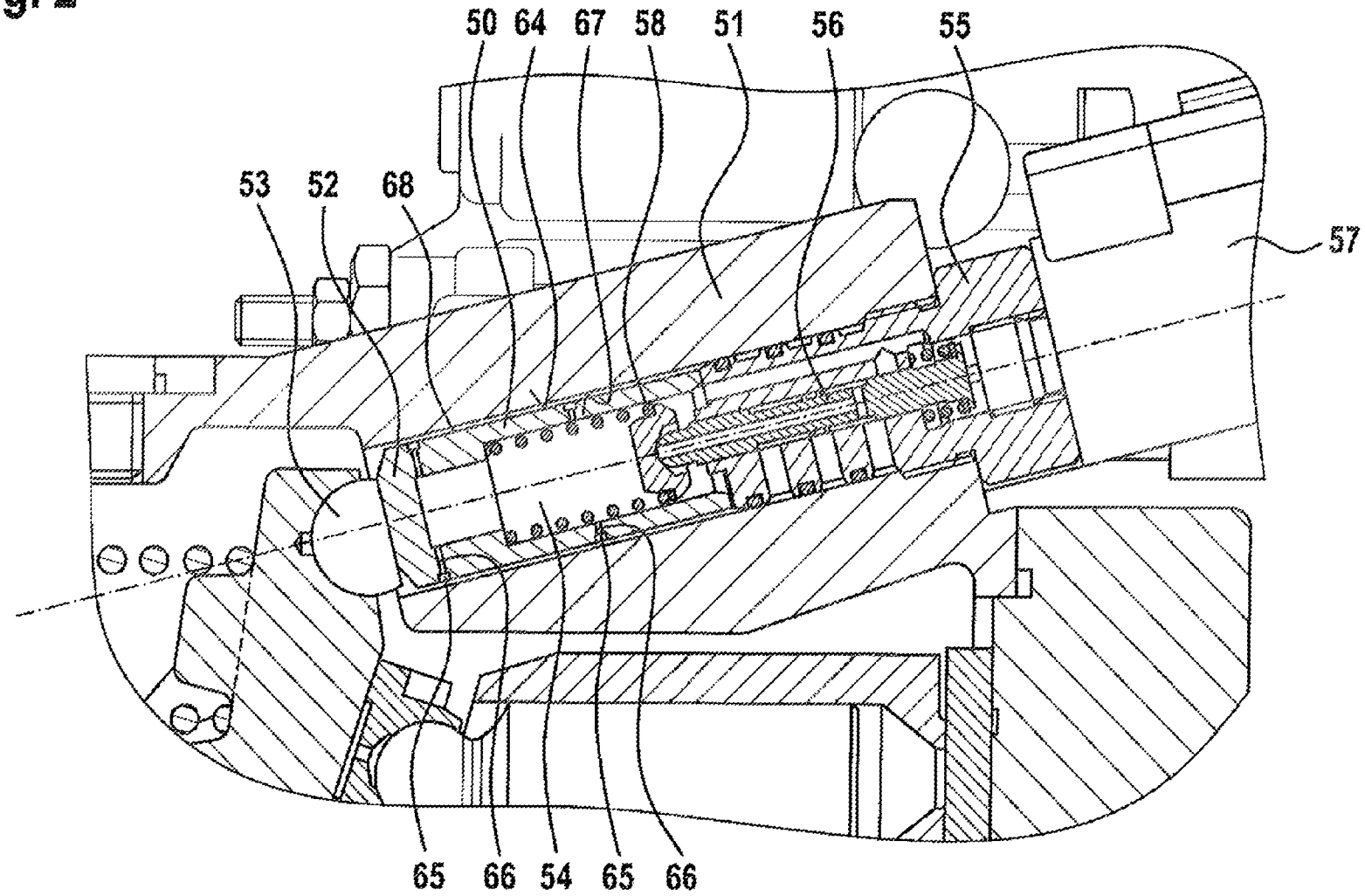
FIG. 2 shows a longitudinal section through the first exemplary embodiment in the region of the adjusting piston on a scale enlarged in comparison to FIG. 1.

The hydrostatic axial piston machines according to FIGS. 1, 2 and 8 are provided in order, as an axial piston pump, the displacement volume of which is adjustable, to supply one or more hydraulic consumers, such as, for example, hydraulic cylinders, with pressure medium in an open hydraulic circuit, and are in the form of a swashplate design. An open hydraulic circuit means that the axial piston pump sucks up pressure medium from a tank via an intake connection 8 and outputs same via a delivery connection 9 to the hydraulic consumers, and that the pressure medium flowing away from the hydraulic consumers flows back into the tank. The intake connection 8 and the delivery connection 9 are the two working connections of the axial piston pump that are indicated by dashed circles in FIG. 1. The volumetric flow of the axial piston pump is proportional to the driving rotational speed and to the displacement volume which is the quantity of pressure medium conveyed per rotation.

The axial piston pump shown in FIGS. 1 and 2 comprises a housing 10 with a pot-like housing part 11 and with a connection plate 12, in which the working connections are formed and by which the open end of the housing part 11 is closed. The axial piston pump furthermore comprises a drive shaft 13, a cylinder drum 14 as rotor, a control plate 15, which is a control plate separate from the connection plate 12 and which is arranged between the cylinder drum 14 and the connection plate 12 and which is stationary relative to the connection plate, and, as lifting element, a swashplate 17, the inclination of which is adjustable with respect to the axis of rotation 16 of the drive shaft 13 and which, because of its pivotability, is also called a pivoting cradle. The latter can be pivoted between a position in which it is virtually perpendicular to the axis of the drive shaft 12 and which is referred to as the zero position, and a position of maximum pivoting angle, which is shown in FIG. 1. Pivoting beyond the zero position is not possible. The cylinder drum 14, the control plate 15 and the pivoting cradle 17 are accommodated by the interior space 18 of the housing part 11.

To remove leakage oil, the housing part 11 has a leakage oil connection 19 which is closed by a closure screw 20 in FIG. 1.

The drive shaft 13 is mounted in the base of the housing part 11 and in the connection plate 12 via tapered roller bearings 21 and 22 so as to be rotatable about the axis of rotation 16 and reaches in a centered manner through a central aperture of the cylinder drum 14. The latter is connected to the drive shaft 13 for rotation therewith, but so as to be movable axially, and can therefore lie against the control plate 15 without play.

The cylinder drum 14 is essentially a circular-cylindrical body with a center axis 25. It has a central cavity 26 which is continuous in the direction of the center axis and through which the drive shaft 13 passes. The central cavity 26 accommodates a helical compression spring 27 which surrounds the drive shaft 13 and, at its one end, is supported on a securing ring 28 inserted into the cylinder drum 14 and at its other end is ultimately supported on the swashplate 17 and presses the cylinder drum against the control plate 15. In the region of a drum neck which projects in the direction of the pivoting cradle 17 and has a reduced outside diameter, the cylinder drum 14 is provided on the inside with a toothing 29 which engages in a corresponding toothing 30 of the drive shaft 13. The cylinder drum 14 is connected to the drive shaft 13 for rotation therewith, but so as to be movable axially, via the toothings. Owing to the axial movability, the cylinder drum 14 can be pressed by the helical compression spring 27 against the control plate 14 without play.

A plurality of, for example seven, cross-sectionally circular-cylindrical cylinder chambers 35 are introduced into the cylinder drum 14 in a manner distributed uniformly over the circumference lying on the same reference circle, said cylinder chambers running parallel to the center axis 25, which coincides with the axis of rotation 16 of the drive shaft 13. The cylinder chambers because of their circular-cylindrical cross section are referred to below as cylinder bores even if they are not produced or are not solely produced from the full material by drilling. A positive displacement piston 36 as the positive displacement element is accommodated by each cylinder bore 35 and guided in the longitudinal direction.

At the end facing the pivoting cradle 17, the positive displacement pistons 36 have a spherical head 37 which captively enters a corresponding recess of a sliding shoe 38, and therefore a ball and socket joint is formed between the positive displacement piston and sliding shoe. The positive displacement pistons 36 are supported on the pivoting cradle 17 by means of the sliding shoes 38, and therefore said positive displacement pistons execute a stroke movement in the cylinder bores 35 during operation. The size of the stroke is determined here by the inclination of the pivotable pivoting cradle 17. An adjustment device 40 is provided for adjusting the inclination of the pivoting cradle 17.

So that the positive displacement pistons 36 do not lift off from the pivoting cradle 17, but rather remain on the pivoting cradle even during what is referred to as the intake stroke, a pull-back plate 41 is provided which is loaded in a known manner in the direction of the pivoting cradle by the helical compression spring 27 via various components which are not denoted specifically. The second end of the helical compression spring 27 is therefore supported on the pivoting cradle 17 via, inter alia, the pull-back plate 41 and the sliding shoes 38 and therefore not only ensures that the cylinder drum 14 is pressed against the control plate 15 even without operating pressure, but also that the positive displacement pistons 36 are pulled out of the cylinder bores 35 during the intake stroke and the sliding shoes 38 remain on the pivoting cradle 17.

The pivoting cradle 17 is mounted in the housing 10 via two circular-cylindrical bearing surfaces 42 in bearing shells 43, which are inserted in the housing part 11, so as to be pivotable about a pivot axis 44 which runs perpendicular to the plane of the drawing according to FIG. 1. Specifically, the pivoting cradle is mounted excentrically. The pivot axis 44 is therefore at a distance from the axis of rotation 16 of the drive shaft 12 and is shifted out of the axis of rotation 16 toward the side on which the adjustment device 40 acts on the pivoting cradle.

The adjustment device 40 enables the pivoting cradle 15 to be adjusted only toward smaller pivoting angles. The pivoting angle is increased firstly by a resetting spring 45 which is clamped between the housing 10 and the pivoting cradle 17 and ensures that the pivoting cradle 17 is pivoted out to the maximum when unpressurized. Secondly, because of the excentric mounting of the pivoting cradle 17, the drive mechanism forces which are exerted on the pivoting cradle by the positive displacement pistons 36, which are located specifically on the high pressure side, act in the pivoting-out direction during operation.

The adjustment device 40 comprises an adjusting piston 50 which is of cup-shaped design and is guided in a sliding manner in a circular-cylindrical receptacle 51, called cylinder below, of the housing 11. The cylinder 51 is open toward the interior space 18 and outward and has an axis which, together with the axis of rotation 16 of the drive shaft 13, defines a plane to which the pivot axis 44 of the pivoting cradle 17 is perpendicular. The axis of the cylinder 51 is only slightly inclined toward the axis of rotation 16, and therefore the adjusting piston 50 is also moved in a direction which is slightly inclined with respect to the axis of rotation 16. If an adjusting piston is slightly inclined in such a manner, or guided parallel to the axis of rotation of the drive shaft, in a hydrostatic axial piston machine of swashplate design, an axial piston machine with longitudinal adjustment is referred to.

The adjusting piston 50 lies with the outer side of its base 52 against a sliding block 53, which is inserted in a spherical cap of the pivoting cradle 17 so as to be movable on all sides, but captively. The space in the interior of the adjusting piston 50 and in front of the open end side of the adjusting piston forms the adjusting chamber 54. The latter is therefore closed in the one direction with respect to the interior of the housing 11 by the base of the adjusting piston 50. A control valve 55 is inserted from the outside into the cylinder 51, said control valve closing off the adjusting chamber 54 to the outside and controlling the inflow and the outflow of pressure fluid into and out of the adjusting chamber 54. The control valve 55 has a valve piston 56 which is acted upon in the one direction by a proportional solenoid 57 and in the other direction by a helical compression spring 58, which is supported on the adjusting piston 50. The valve piston 56 is equalized in respect of the pressure in the adjusting chamber 54. As a result, in the event of a certain energizing of the proportional solenoid 57 and therefore in the event of a certain magnetic force exerted on the valve piston 56, the adjusting piston 50 and, with the latter, the pivoting cradle 17 are each brought into such a position that the force of the helical compression spring 58 is precisely the same size as the magnetic force. An electroproportional adjustment of the pivoting cradle 17 is thereby obtained.

The adjusting piston 50 is mounted hydrostatically directly in the cylinder 51. For this purpose, it is provided on its outer surface 64, which forms a bearing surface, with at least one ring of a plurality of, here eight, identical individual pressure pockets 65. The angular distance between two adjacent pressure pockets 65 is always the same. The pressure pockets 65 are very narrow in the axial direction of the adjusting piston 50. In the circumferential direction, a pressure pocket 65 extends over approximately eight percent of the circumference of the adjusting piston 50 and is of a length in the circumferential direction that is approximately ten to twelve times the size of the width in the axial direction. The pressure pockets 65 are therefore narrow grooves which can be produced by a milling or sawing tool.

Each pressure pocket 65 is fluidically connected via a bore 66 to the interior of the adjusting piston 50 and therefore to the adjusting chamber 54. The bore 66 constitutes a fixed throttle. Between the outer surface 64 of the adjusting piston 50 and the inner wall 67 of the cylinder 51, which inner wall constitutes the housing-side bearing surface for the adjusting piston 50, there is a bearing gap 68 via which pressure fluid flowing into a pressure pocket 65 via the fixed throttle 66 can enter into the interior space 18 of the housing 10, in which tank pressure prevails. The bearing gap 68 constitutes a variable throttle, which is arranged in series with the fixed throttle, for the outflow of pressure fluid from a pressure pocket 65 into the housing.

If a pressure fluid flows via two throttles connected in series to each other, a pressure arises between the two throttles that depends on the pressure upstream of the first throttle and on the pressure downstream of the second throttle and on the respective hydraulic resistance of the two throttles. If the two throttles have the same hydraulic resistance, the pressure between the two throttles lies precisely in the center between the upstream pressure and the downstream pressure. If the hydraulic resistance of the second throttle is lower than that of the first throttle, the pressure between the two throttles is closer to the downstream pressure, and, if the hydraulic resistance of the second throttle is greater than that of the first throttle, the pressure between the two throttles is closer to the upstream pressure.

If the adjusting piston 50 is centered with respect to the cylinder 51, the hydraulic resistance of the bearing gap 68 is identical for the pressure pockets 65 of an encircling ring of pressure pockets. Since the fixed throttles in any case have the same hydraulic resistance for all of the pressure pockets 65, the same pressure prevails in all of the pressure pockets 65 and the forces generated on the adjusting piston by the pressures in the pressure pockets cancel one another out. If the adjusting piston 50 is now shifted toward one side, the bearing gap on this side becomes smaller and therefore the hydraulic resistance of the variable throttles becomes greater and, on the other side, the bearing gap becomes larger and therefore the hydraulic resistance of the variable throttles becomes smaller. There is no change to the hydraulic resistance of the fixed throttles. The pressures in the pressure pockets therefore increase on the side toward which the adjusting piston 50 has shifted while, on the other side, the pressures in the pressure pockets decrease. A force imbalance is produced which forces the adjusting piston 50 back into the centered position. A constant width of the bearing gap around the adjusting piston 50 is thereby achieved.

In the exemplary embodiment shown in FIG. 1 of a hydrostatic axial piston pump according to the disclosure, the adjusting piston 50 has two rings of eight pressure pockets 65 in each case. The first ring is located at a small distance from that end side of the adjusting piston which faces the pivoting cradle 17, and the second ring is located approximately in the center of the adjusting piston. The positioning of the first ring does indeed lead to the fact that, starting from a position of the adjusting position corresponding to the maximally pivoted pivoting cradle, the pressure pockets 65 of said ring are no longer overlapped after a certain stroke by the bearing surface of the cylinder 51 and pressure fluid flows out of the adjusting chamber 54 into the interior space 18 of the housing 10 via the fixed throttles 66 of the pressure pockets 65 which are no longer overlapped. However, the outflowing amount is small since the diameter of the fixed throttles lies within the range of between 0.05 mm and 0.5 mm. The second ring of pressure pockets 65 remains overlapped by the bearing surface of the cylinder 51 in each position of the adjusting piston 50.

Figure 3:
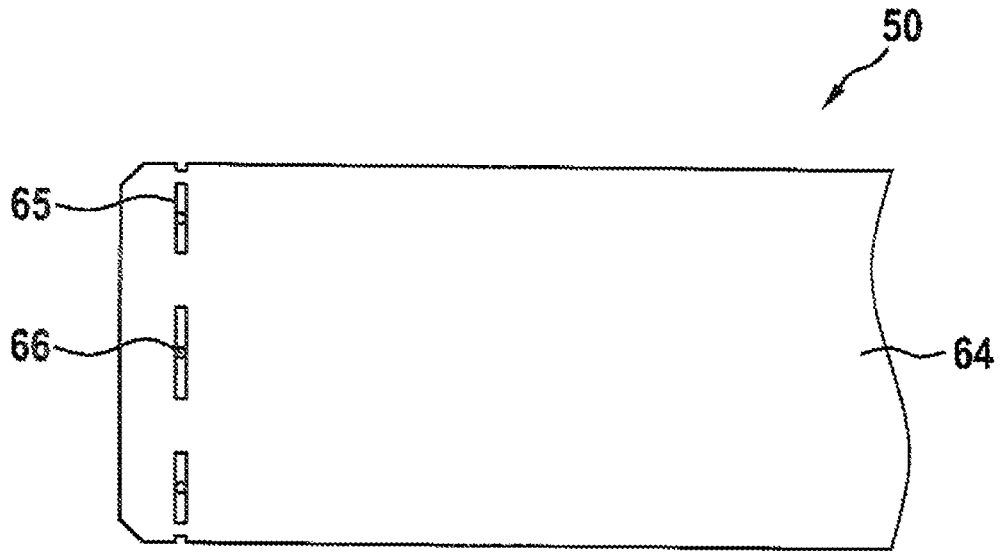
FIG. 3 shows a view of a first variant of an adjusting piston useable in the first exemplary embodiment, wherein said adjusting piston has a single ring of pressure pockets.

The variant of an adjusting piston 50 that is shown in FIG. 3 has only one ring of eight individual pressure pockets 65, wherein the pressure pockets are located at a small distance from that end side of the adjusting piston which faces the pivoting cradle 17.

Figure 4:
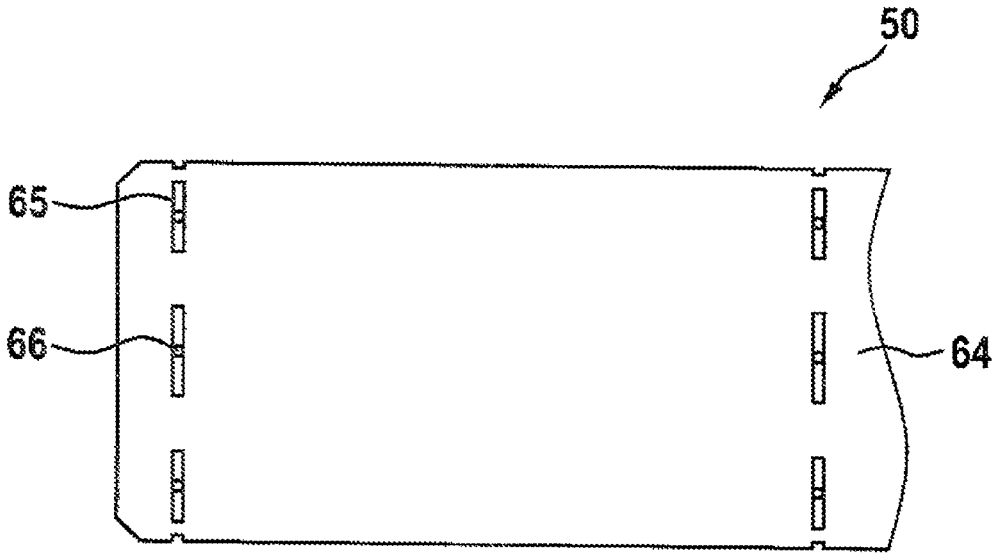
FIG. 4 shows a view of a second variant of an adjusting piston useable in the first exemplary embodiment, wherein said adjusting piston, like the adjusting piston from FIGS. 1 and 2, in turn has two rings of pressure pockets.

The variant of an adjusting piston 50 that is shown in FIG. 4 in turn has two rings of eight individual pressure pockets 65 in each case, wherein the first ring is located at a small distance from that end side of the adjusting piston which faces the pivoting cradle 17 and the second ring is located at a small distance from the open end side of the adjusting piston.

Figure 5:
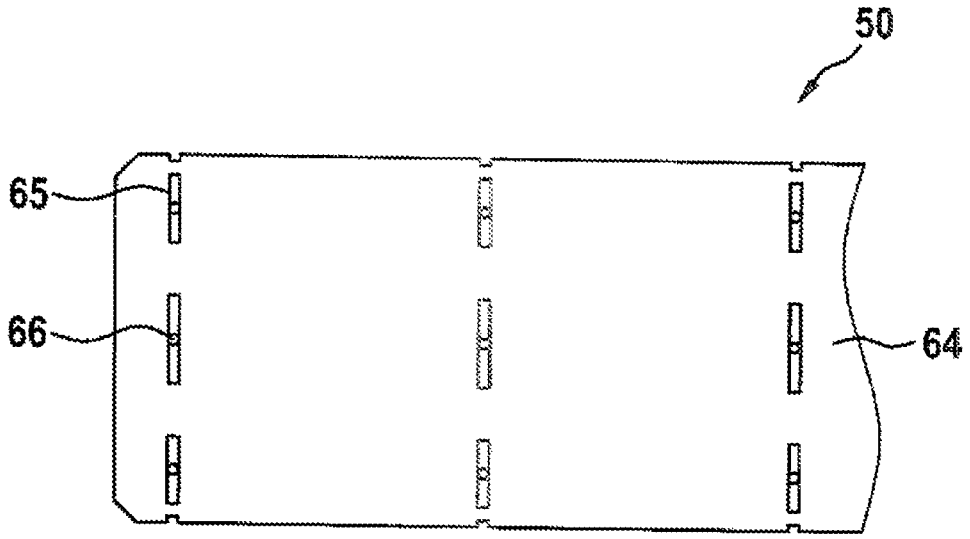
FIG. 5 shows a view of a third variant of an adjusting piston useable in the first exemplary embodiment, wherein said adjusting piston has three rings of pressure pockets.

The variant of an adjusting piston 50 that is shown in FIG. 5 has a further ring of pressure pockets 65, approximately in the center of the adjusting piston, in addition to the two rings of pressure pockets 65 of the variant from FIG. 4.

Figure 6:
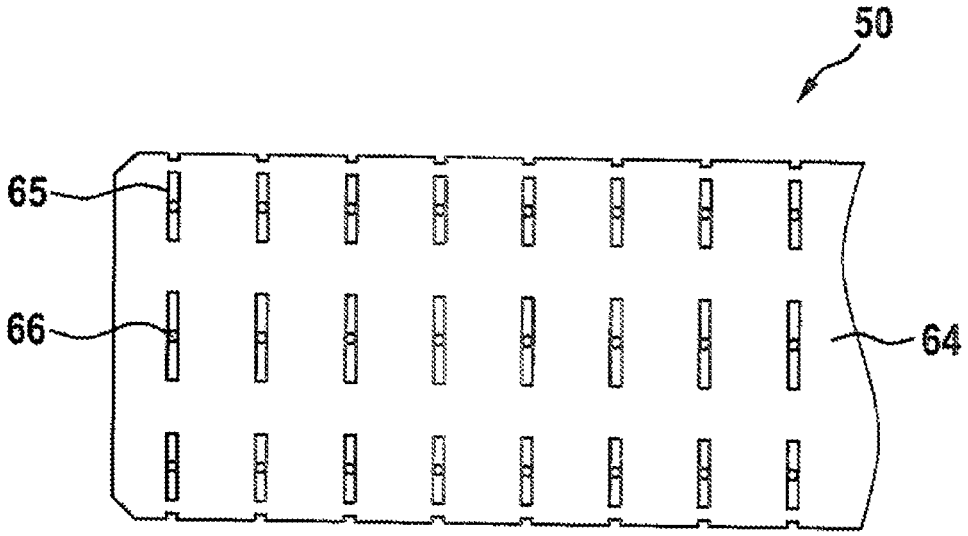
FIG. 6 shows a view of a fourth variant of an adjusting piston useable in the first exemplary embodiment, wherein said adjusting piston has a total of eight rings of pressure pockets over its entire length.

The variant of an adjusting piston 50 that is shown in FIG. 6 has a total of eight rings having eight pressure pockets 65 in each case, wherein the rings are distributed at identical distances from one another over the entire length of the adjusting piston.

In a further variant which is not illustrated, the ring which, in the variant according to FIG. 5, is located at the small distance from that end side of the adjusting piston 50 which faces the pivoting cradle 17 can be omitted, and therefore only the ring on the other end side and the ring in the center of the adjusting piston are present. All of the pressure pockets are then always overlapped irrespective of the operational position of the adjusting piston.

In this variant and also in the variants according to FIGS. 5 and 6, the adjusting piston is readily centered over its entire length in each position.

Figure 7:
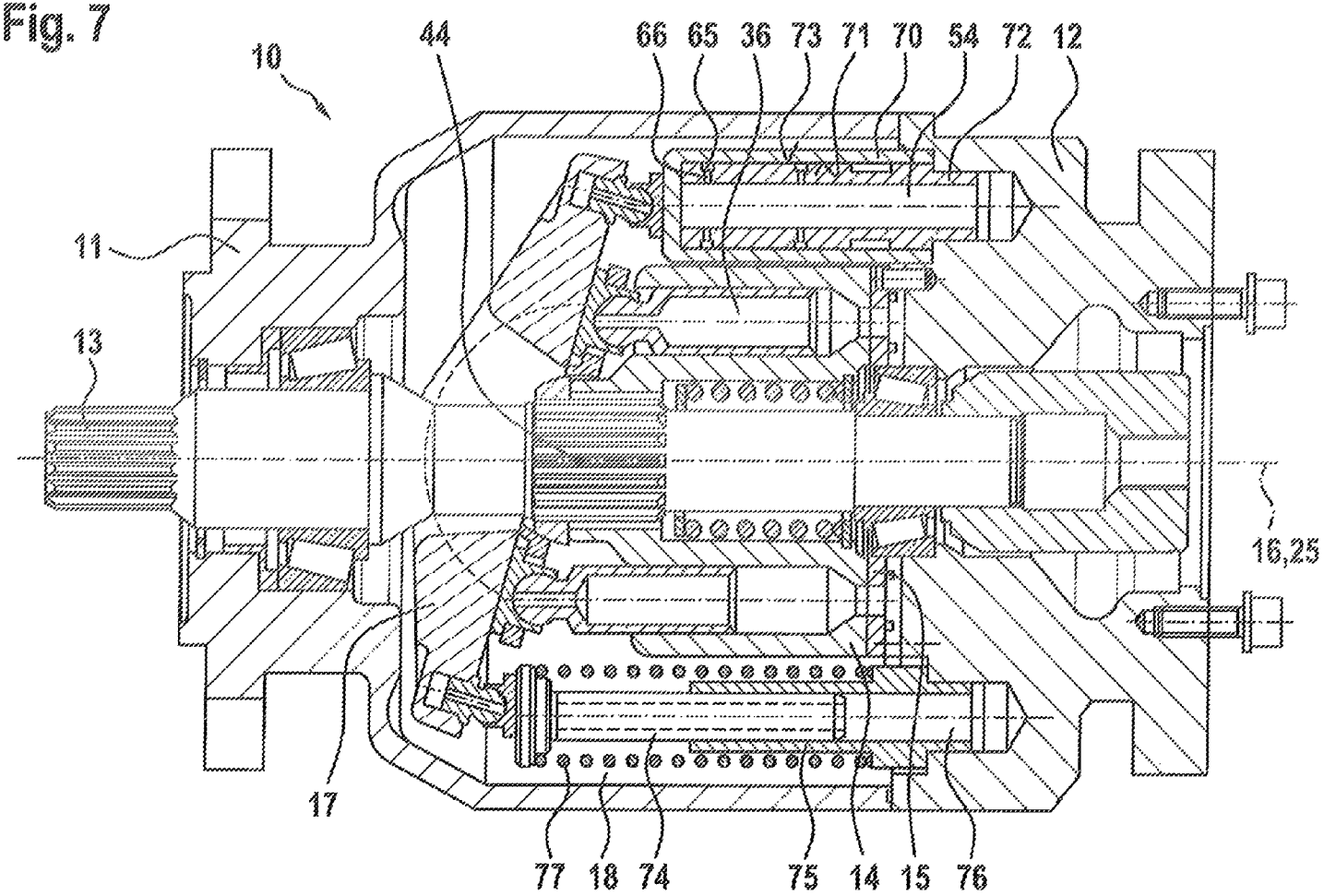
FIG. 7 shows a longitudinal section through the second exemplary embodiment, in which the swashplate is pivoted in the one direction by an adjusting piston and in the opposite direction by a spring and a counter piston.

The hydrostatic axial piston pump shown in FIG. 7, like the axial piston pump from FIG. 1, comprises a housing 10 with a pot-like housing part 11 and with a connection plate 12, in which the working connections are formed and by which the open end of the housing part 11 is closed. The axial piston pump furthermore comprises a drive shaft 13, a cylinder drum 14 as rotor, a control plate 15, which is a control plate separate from the connection plate 12 and which is arranged between the cylinder drum 14 and the connection plate 12 and which is stationary relative to the connection plate, and, as lifting element, a pivoting cradle 17, the inclination of which is adjustable with respect to the axis of rotation 16 of the drive shaft 13. Said pivoting cradle can be pivoted between a position in which it is virtually perpendicular to the axis of the drive shaft 12 and which is referred to as the zero position, and a position of maximum pivoting angle that is shown in FIG. 7. The cylinder drum 14, the control plate 15 and the pivoting cradle 17 are accommodated by the interior space 18 of the housing part 11.

Unlike in the case of the exemplary embodiment shown in FIG. 1, the pivoting cradle 17 is mounted centrally in the case of the axial piston pump according to FIG. 7. The pivot axis 44 of the pivoting cradle therefore intersects the axis of rotation 16 of the drive shaft 13 perpendicularly. For pivoting the pivoting cradle in the one direction, there is a cup-shaped adjusting piston 70 which bounds an adjusting chamber 54, to which pressure fluid can be supplied via a control valve, not shown specifically, and from which pressure fluid can be displaced via the control valve. Unlike in the case of the exemplary embodiment according to FIG. 1, the adjusting piston 70 is not mounted in a circular-cylindrical recess of the housing part 11, but rather with an inner surface 71 on the outside of a hollow cylinder 72 which is inserted into the connection plate 12 and the inner part of which is the adjusting chamber 54. Pressure pockets 65 are now located in the outer surface 73 of the hollow cylinder 72. The pressure pockets 65 are fluidically connected to the adjusting chamber 54 via bores which are introduced into the wall of the hollow cylinder 72 and which constitute the fixed throttle 66 assigned to the pressure pockets. The pressure pockets can be arranged on the hollow cylinder 72 in various variants analogous to the variants shown in FIGS. 1 to 6 for the arrangement on the adjusting piston.

For the adjusting of the pivoting cradle 17 in the opposite direction, there is an adjusting piston 74, which is also called a counter piston and is mounted on the inside in a hollow cylinder 75 inserted into the connection plate 12 and is adjacent to an adjusting chamber 76, and a helical compression spring 77, which surrounds the hollow cylinder 75 and the counter piston 74 and, owing to the pivoting cradle 17, is pivoted to the maximum when there are no pressures in the adjusting chambers. The pressure from the delivery connection of the pump is in each case present in the adjusting chamber 76. Since, however, the operative surface of the counter piston 74 is smaller than the operative surface of the adjusting piston 70, the pivoting cradle 17 can be pivoted by the adjusting piston 70 counter to the forces exerted on the pivoting cradle by the helical compression spring 77 and by the counter piston 74.

In principle, it is conceivable to also provide a hydrostatic mounting on the hollow cylinder 75 for the counter piston 74.

Unlike in the case of the exemplary embodiments shown, in which the pressure pockets are each located in an outer surface, serving as bearing surface, of a component of the hydrostatic positive displacement machine, the pressure pockets can also be located in the inner surface serving as a bearing surface. In a modification of the exemplary embodiment from FIG. 1, the pressure pockets would then be located in the wall of the cylinder 51, i.e. in the housing part 11. In a modification of the exemplary embodiment according to FIG. 7, the pressure pockets could be introduced into the inner surface of the adjusting piston 70. The fixed throttles are then realized by bores in the housing part 11 or in the adjusting piston 70. This has the advantage already explained further above that pressure pockets can be present over the entire guide length without pressure fluid flowing out of the adjusting chamber into the housing of the positive displacement machine via the fixed throttles and the pressure pockets. The pressure pockets which are not overlapped by the other bearing surface are open in the inlet and in the outlet toward the adjusting chamber and have no effect.

Similarly unlike in the case of the exemplary embodiments shown, an intermediate element containing the pressure pockets can be fitted between adjusting piston and guide. In addition, the bores constituting the fixed throttles are realized in the intermediate element. The intermediate element appears to be particularly advantageous for providing the pressure pockets in an inner surface serving as the bearing surface. The intermediate element is a hollow cylinder, into the interior wall of which the pressure pockets are milled and in which the bores constituting the fixed throttles are introduced from the outside. In addition, longitudinal grooves which are initially still open can be formed in the outer surface of the intermediate element and connect the fixed throttles to the adjusting chamber. After the intermediate element is inserted into the housing or into the adjusting piston, the longitudinal grooves are covered and are therefore only still open toward the adjusting chamber. Pressure pockets are therefore obtained in an inner bearing surface with the advantage mentioned above.

LIST OF REFERENCE SIGNS

8 Intake connection
9 Delivery connection
10 Housing
11 Pot-like housing part
12 Connection plate
13 Drive shaft
14 Cylinder drum
15 Control plate
16 Axis of rotation of 13
17 Pivoting cradle
18 Interior space of 11
19 Leakage oil connection
20 Closure screw
21 Tapered roller bearing
22 Tapered roller bearing
25 Center axis of 14
26 Central cavity of 14
27 Helical compression spring
28 Securing ring
29 Toothing on 14
30 Toothing on 13
35 Cylinder bores in 14
36 Positive displacement piston
37 Spherical head of 36
38 Sliding shoe
40 Adjustment device
41 Pull-back plate
42 Bearing surfaces of 17
43 Bearing shells
44 Pivot axis of 17
45 Resetting spring
50 Adjusting piston
51 Cylinder for 50
52 Base of 50
53 Sliding block
54 Adjusting chamber
55 Control valve
56 Valve piston
57 Proportional solenoid
58 Helical compression spring
64 Outer surface of 50
65 Pressure pockets
66 Fixed throttle
67 Inner wall of 51
68 Bearing gap between 50 and 51
70 Adjusting piston
71 Inner surface of 70
72 Hollow cylinder
73 Outer surface of 72
74 Counter piston
75 Hollow cylinder
76 Adjusting chamber
77 Helical compression spring

The invention claimed is:

1. A hydrostatic positive displacement machine that has an adjustable swept volume, comprising:

a lifting element;

a rotor having a plurality of positive displacement elements supported on the lifting element; and a hydraulic adjusting device configured to adjust the swept volume, the hydraulic adjusting device comprising an adjusting piston that is mounted in or on a cylinder, is movable axially rectilinearly in relation to the cylinder, and is adjacent to a pressurizable adjusting chamber, wherein a bearing gap is defined between a circular-cylindrical first bearing surface of the adjusting piston and a circular-cylindrical second bearing surface of the cylinder, wherein the adjusting piston is mounted hydrostatically, wherein at least three individual pressure pockets are distributed uniformly in a row over a circumference of one of the first and second bearing surfaces, and wherein pressure fluid flows into each respective pressure pocket of the at least three pressure pockets via a respective fixed throttle, which is assigned only to the respective pressure pocket, and the pressure fluid flows out of each respective pressure pocket via the bearing gap.

2. The hydrostatic positive displacement machine according to claim 1, wherein the respective fixed throttles are arranged between the adjusting chamber and the respective pressure pockets, and the pressure fluid flows into the respective pressure pockets from the adjusting chamber.

3. The hydrostatic positive displacement machine according to claim 1, wherein each respective fixed throttle is a bore having a diameter of between 0.05 mm and 0.5 mm.

4. The hydrostatic positive displacement machine according to claim 1, wherein all of the pressure pockets have the same shape and size and all of the fixed throttles have the same diameter.

5. The hydrostatic positive displacement machine according to claim 1, wherein the at least three pressure pockets includes a plurality of rings of pressure pockets defined one behind another in an axial direction in the one of the first and second bearing surfaces.

6. The hydrostatic positive displacement machine according to claim 1, wherein the at least three pressure pockets are located at least in a region of the one of the first and second bearing surfaces overlapped by the other of the first and second bearing surfaces in each position of the adjusting piston.

7. The hydrostatic positive displacement machine according to claim 1, wherein each of the at least three pressure pockets is rectangular.

8. The hydrostatic positive displacement machine according to claim 1, wherein an extent of each of the at least three pressure pockets is greater in the circumferential direction than in an axial direction.

9. The hydrostatic positive displacement machine according to claim 7, wherein an extent of each of the at least three pressure pockets is approximately 10 times as large in the circumferential direction as in an axial direction.

10. The hydrostatic positive displacement machine according to claim 1, wherein the at least three pressure pockets are defined in the first bearing surface of the adjusting piston.

11. The hydrostatic positive displacement machine according to claim 1, wherein:

the adjusting piston is configured in a cup-shaped manner with an interior space and is mounted and guided in the cylinder by an outer surface of the adjusting piston, the at least three pressure pockets are defined in the outer surface of the adjusting piston, and each respective fixed throttle is formed by a bore which leads from the interior space through a wall of the adjusting piston into the respective pressure pocket.

12. The hydrostatic positive displacement machine according to claim 1, wherein the one of the first and second bearing surfaces in which the at least three pressure pockets are defined is directed inward.

13. The hydrostatic positive displacement machine according to claim 1, wherein at least three pressure pockets are present in the one of the first and second bearing surfaces over virtually the entire axial length of the one of the first and second bearing surfaces.

14. The hydrostatic positive displacement machine according to claim 1, wherein the hydrostatic positive displacement machine is a hydrostatic axial piston machine in which the adjusting piston is movable essentially in an axial direction.

15. The hydrostatic positive displacement machine according to claim 14, wherein the hydrostatic axial displacement machine is of swashplate design.

* * * * *